United States Patent [19]

Giarda et al.

[11] Patent Number: 4,965,045

[45] Date of Patent: Oct. 23, 1990

[54] COPPER-BASED ALLOY FOR OBTAINING ALUMINUM-BETA-BRASSES, CONTAINING GRAIN SIZE REDUCING ADDITIVES OF TITANIUM AND NIOBIUM

[75] Inventors: Andrea Giarda; Sergio Ceresara, both of Florence, Italy

[73] Assignee: Europe Metalli - LMI S.p.A., Florence, Italy

[21] Appl. No.: 288,005

[22] Filed: Dec. 21, 1988

[30] Foreign Application Priority Data

Dec. 23, 1987 [IT] Italy ..... 68115 A/87

[51] Int. Cl.[5] ..... C22F 1/08

[52] U.S. Cl. ..... 420/478; 148/402; 420/484

[58] Field of Search ..... 420/478, 484; 148/402

[56] References Cited

U.S. PATENT DOCUMENTS

| | | | |
|---|---|---|---|
| 4,144,104 | 3/1979 | Brooks | 420/478 |
| 4,148,635 | 4/1979 | Smith, Jr. | 420/478 |
| 4,472,213 | 9/1984 | Tabei et al. | 420/478 |

FOREIGN PATENT DOCUMENTS

| | | | |
|---|---|---|---|
| 0215447 | 12/1984 | Japan | 420/478 |
| 0110833 | 6/1985 | Japan | 420/478 |

*Primary Examiner*—Upendra Roy

*Attorney, Agent, or Firm*—Klauber & Jackson

[57] ABSTRACT

A new copper-based metallic alloy is described containing principally Zn and Al in quantities such as to render it capable, after solution heat treatment at high temperature, and tempering, of assuming a crystalline structure of Beta type; its principal characteristics lies in the fact that it simultaneously contains, as grain size reducing additives, Nb and Ti in an overall quantity lying between 0.01 and 0.2% by weight.

2 Claims, 3 Drawing Sheets

TEM ELECTRONIC MICROGRAPHY SHOWING PARTICLES (BLACK ONES) HAVING THE COMPOSITION SHOWN IN FIG.3 (X 75.000)

TEM ELECTRONIC MICROGRAPHY SHOWING A PARTICLE OF SMALLER DIMENSIONS, HAVING THE COMPOSITION SHOWN IN FIG.3 (X 270.000)

COPPER-BASED ALLOY FOR OBTAINING ALUMINUM-BETA-BRASSES, CONTAINING GRAIN SIZE REDUCING ADDITIVES OF TITANIUM AND NIOBIUM

BACKGROUND OF THE INVENTION

The present invention relates to a copper-based metal alloy containing zinc and aluminium in quantities such as to form a brass characterised, after suitable high temperature homogenisation treatment and tempering, by a crystalline structure of Beta type; in particular the invention relates to an alloy of the said type also containing further alloying elements the functionof which is to reduce the grain size of the alloy itself.

It is known that alloys of the Cu-Zn-Al system of appropriate composition, after suitable solution heat treatment and tempering, manifest a Beta-type structure referred to as "aluminium-Beta-brasses". These brasses are particularly interesting for some of their particular physical and mechanical characteristics such as a high capacity for damping, pseudo-elastic or super-elastic effect, and the shape memory effect both the irreversible or "one way" effect and the reversible or "two way" effect. This latter characteristic particularly qualifies such alloys for the full title of SME, namely the "shape memory effect" or form memory.

As is likewise known, such properties, and in particular the shape memory effect, are allied to a martensitic transition phase of thermo-elastic type, or rather to the formation and growth within the "Beta" structure of martensitic plates; this phase transformation is reversible and controlled by the temperature and elastic stress state of the material. In the absence of mechanical stresses it is characterised by two pairs of initial and final transformation temperatures, respectively indicated Ms and Mf (of the martensitic Beta phase) and As and Af (in the reverse transformation). The interest shown in the above-mentioned effects manifested by "Beta" brasses, and in particular those connected with the shape memory effect and the super-elastic effect, is essentially bound up with the fact that the materials in question are able to perform simultaneously the functions of heat sensor and mechanical actuator. In other words an SME element performs the functions conventionally fulfilled by a complex chain of devices (for example heat sensor, amplifier, relay/proportional actuator, etc).

In such applications the materials in question are subjected to thermo-mechanical stresses of cyclic type and can consequently manifest fatigue phenomena of thermo-mechanical type if suitable arrangements are not adopted. It is known that an essential condition for achieving a good behavior of metal materials when faced with fatigue in general and thermo-mechanical fatigue in particular, is obtaining a very fine and homogeneous grain structure.

Beta-brasses which do not have grain size reducing addition elements have, on the other hand, a decidedly large grain structure and are therefore of low reliability in the long term in thermo-mechanical fatigue conditions.

SUMMARY OF THE INVENTION

The object of the present invention is that of providing a Cu-Zn-Al alloy of a composition such as to permit Beta-brasses to be produced with SME properties, characterised by a fine crystalline grain structure and having high resistance to thermo-mechanical fatigue as well as a good workability.

The said object is achieved by the invention according to which there is provided a copper-based metal alloy, in particular for obtaining aluminium-Beta-brasses, characterised by the fact that it contains from 5% to 35% by weight of zinc, from 1% to 10% by weight of aluminium and a total lying between 0.01% and 0.2% by weight of niobium and titanium, the remainder being copper, possibly including impurities and other alloying elements, the ratio by weight between the quantity of niobium and the quantity of titanium contained in the said alloy being substantially equal to unity.

In substance the applicant's technicians, following an accurate physical and structural research, have observed that the simultaneous addition to an aluminium-brass of niobium (Nb) and titanium (Ti) in controlled low concentrations and suitably balanced with one another results in an unexpected synergic effect of the two alloying elements which leads to the formation in the metal matrix of the alloy of ternary intermetallic compounds by interaction with aluminium of the Nb-Ti-Al type which are responsible for the marked reduction in the grain size and consequent raised resistance to thermo-mechanical fatigue. The material further has an improved cold workability. It is recalled that intermetallic compounds of the said type present in a finely dispersed form in the metallic matrix act as crystallisation nuclei during the solidification of the material and are further capable of obstructing the growth of grains during subsequent high temperature heat treatments, inhibiting the movement of their boundaries. This results in a marked reduction in the fragility typical of aluminium-Beta-brasses devoid of addition elements, and also an improvement in the ambient temperature workability; moreover the reduction in the grain size produced by the presence of the said intermetallic compounds causes an increase in the characteristics of resistance to thermo-mechanical fatigue of the alloy itself; alloys according to the invention further have great stability at normal working temperatures to which they can be exposed in use, in that the said intermetallic compounds which form following the concurrent addition of niobium and titanium are stable up to high temperatures (900° C.).

Experimental tests conducted by the applicant have moreover determined that to develop the new and appreciable characteristics of alloys according to the invention the addition of niobium and titanium must have an overall percentage, as a sum of the individual contents of Nb and Ti, lying between 0.01 and 0.2% by weight. Moreover, it has surprisingly been found that to obtain the improved results it is necessary to control the ratio by weight between niobium and titanium contained in the alloy in such a way that the content of the two elements is substantially equal. Therefore, the invention relates to copper-based alloys in that this represents the predominant element, including from 5 to 35% by weight of zinc, from 1 to 10% by weight of aluminium, and a total lying between 0.01 and 0.2% by weight of Nb+Ti; the ratio by weight between the quantity of Nb and that of Ti contained in the alloy is substantially equal to unity, and the balance to 100%, or rather the total weight of the alloy, is constituted by copper, possible impurities, and possible further alloying elements which are, however, outside the ambit of the invention and which therefore will not be taken into consideration. The alloy according to the preferred embodiment of the invention includes 0.05% by weight of Ti and 0.05% by weight of Nb, whilst the Al and Zn contents are chosen from time to time according to the type of application in that the value of the temperatures As and Ms essentially depends on the ratio by weight between these latter two elements; in each case the content of Zn and Al must remain substantially within the range of values indicated above and the content of Nb and Ti, considered individually, must not be less than 0.005% by weight otherwise an insufficient grain size reducing effect is achieved; these limitations obviously derive from the lack of an appreciable fraction of tertiary precipitate having a grain size reducing action.

Obtaining and working alloys according to the invention are achieved in a conventional manner by the addition of the alloying elements to the molten copper, in particular by the simultaneous addition of niobium and titanium to a Cu-Zn-Al based alloy, subsequently casting the thus obtained alloy into ingots, working it by extrusion, operating at temperatures of the order of about 800° C., and subsequent working by drawing or cold rolling, interposing between each successive rolling or drawing phase a respective phase of reheating to a suitable temperature; subsequently the alloy is subjected to a solution heat treatment heating to a temperature of about 700°-800° C. and a subsequent sharp cooling (tempering).

BRIEF DESCRIPTION OF THE DRAWINGS

The alloy according to the present invention will now be described with reference to the following Examples, as well as to the attached Figures, in which.

DETAILED DESCRIPTION OF THE INVENTION

Example 1

Experimental melts were made in an induction furnace of a capacity of about 50 kg and subsequently cast into ingots of a diameter of 110 mm, and cooled in water. Charges of 34.5 kg of 99.9 ETP copper, 13.5 kg of Zn, 1.5 kg of Al and 0.5 kg of a pre-alloy of copper containing 10% of Nb and 10% of Ti. The alloy in the molten state thus obtained was cast into ingots and, after solidification, the ingots were subjected to hot extrusion operating at about 800° C. to obtain a half finished product of 25 mm diameter; this half finished product was subjected to cold working tests both by drawing and rolling, each drawing or rolling phase was performed at ambient temperature with intermediate reheating, consisting in raising the half finished product to a temperature of 550° C. and in maintaining the half finished product at this temperature for 0.5 hours. Before withdrawing the samples the wires obtained were wound into the form of coil springs having the following geometry: wire diameter 3 mm, spring diameter 21 mm, number of turns 10. The springs thus obtained were heated to 800° C., maintained at this temperature for 0.5 hours and subsequently tempered by means of cooling by immersion in water at 20° C. Springs were thus obtained which are shown to be capable of being subjected to thermo-mechanical conditioning cycles for obtaining the SME effect, or to be directly utilised in applications which exploit the super-elastic effect. Moreover, an easy workability both during the wire drawing phase and rolling phases is encountered. Upon microscopic examination the samples, after tempering from 900° C. had reduced crystalline grain size dimensions, on average of about 0.1–0.15 mm.

Example 2

Figure 1:
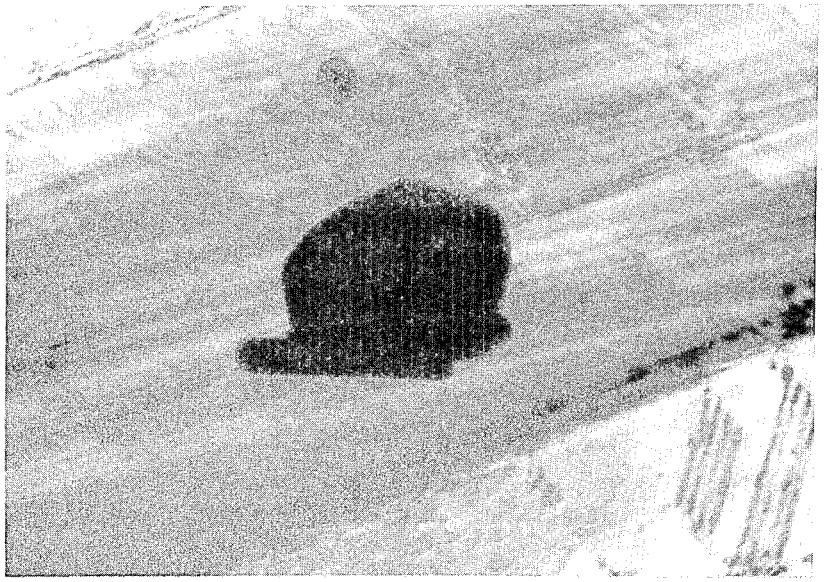
FIGS. 1 and 2 illustrate two respective microphotographs, at different enlargements, of samples of an alloy according to the invention showing coarse tertiary intermetallic particles on the background of a solid solution.
Figure 2:
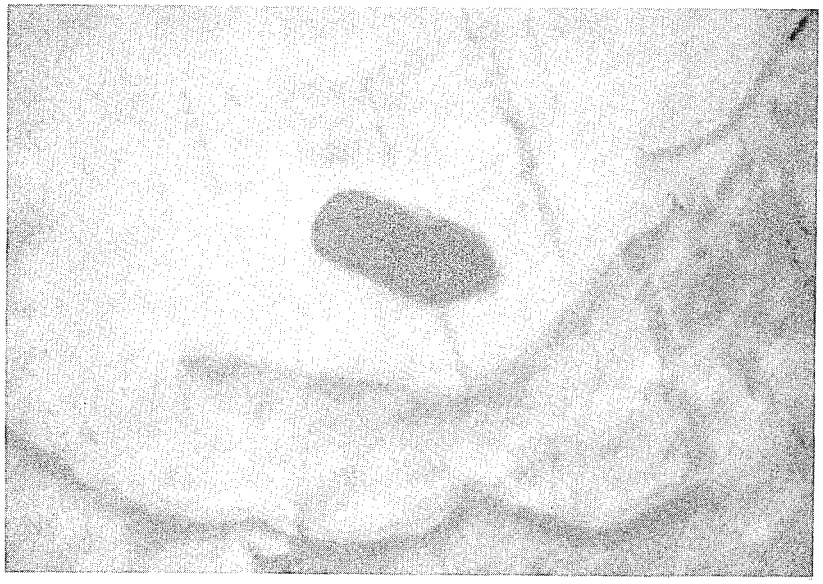
Figure 3:
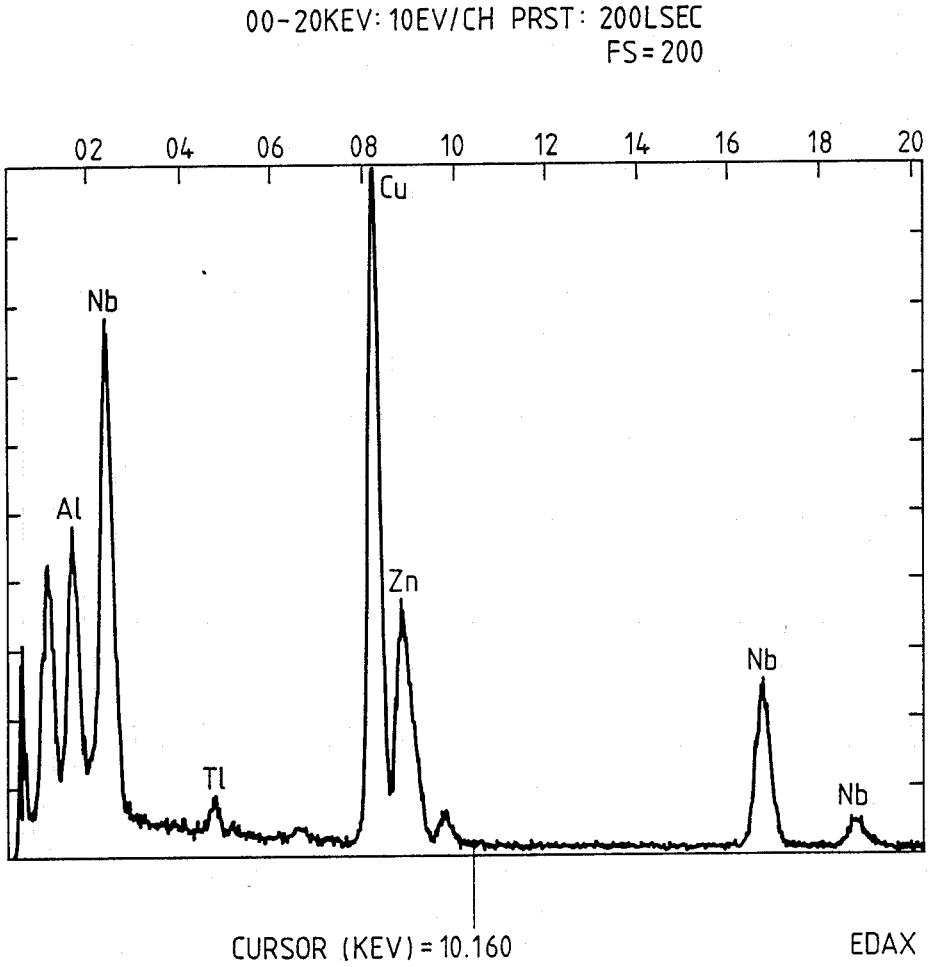
FIGS. 3 and 4 are respectively spectrometric diagrams of the particles and the solid solution respectively of FIGS. 1 and 2.
Figure 4:
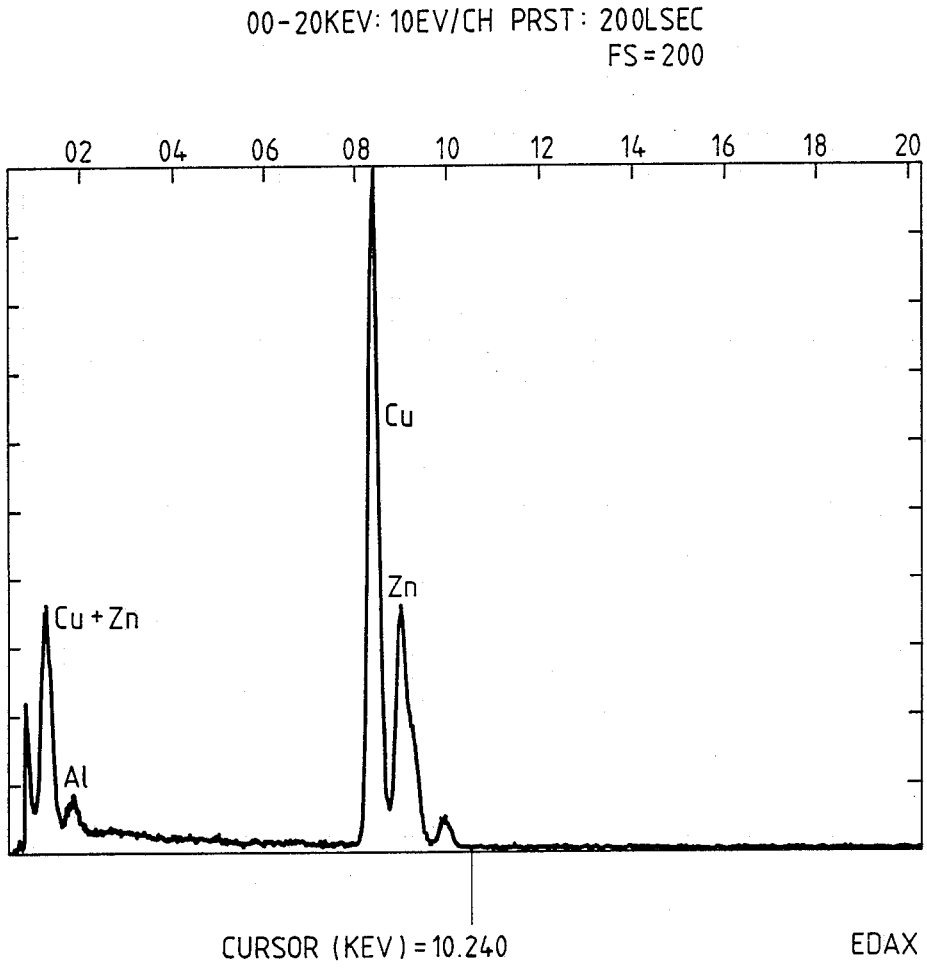

The samples of Example 1, subjected to solution heat treatment and tempering as in Example 1, were subjected to investigation by transmission electron microscope (TEM) and by EDS microanalysis. The results obtained are shown in the microphotographs of FIGS. 1 and 2 and in the graphs of FIGS. 3 and 4. FIG. 1 is a micrograph at an enlargement of ×75,000 showing particles (coarse) of Al-Nb-Ti ternary intermetallic compounds having the composition shown in FIG. 3; FIG. 2 is a micrograph at an enlargement of ×270,000 of a sample similar to that of FIG. 1 and shows a ternary intermetallic particle of smaller dimensions having the same composition as that shown in FIG. 3. FIG. 3 is a spectrum obtained by EDS microanalysis in correspondence with the particles of FIGS. 1 and 2, whilst FIG. 4 is the EDS spectrum of the solid solution in the absence of particles, obtained in the same operating conditions and shown for comparison. The ternary constitution (Al-Nb-Ti) of the coarse particles is evident from the simultaneous presence (FIG. 3) of the Nb and Ti lines (not detectable in the solid solution—FIG. 4—, in the absence of these particles, because of the low mean concentration of elements Nb and Ti) and of the strong heightening of the relative intensity of the Al line with respect to the value observable in the solid solution (FIG. 4), in the absence of particles. In the spectrum of FIG. 4, on the other hand, only the lines of the principal constituents of the alloy are observed and the lower relative intensity of the Al line with respect to that shown in FIG. 3 is evident.

I claim:

1. A copper-based metal alloy for obtaining aluminium-Beta-brasses, comprising from 5% to 35% by weight of zinc, from 1% to 10% by weight of aluminium and a total lying between 0.01% and 0.2% by weight of niobium and titanium, the remainder being copper and incidental impurities and other alloying elements, the ratio by weight between the quantity of niobium and that of titanium contained in the said alloy being substantially equal to unity, and said aluminium, niobium and titanium forming a ternary Al-Nb-Ti intermetallic compound that promotes reduced grain size and increased resistance to thermomechanical fatigue.

2. A metal alloy according to claim 1, wherein said alloy contains 0.1% by weight of niobium and 0.1% by weight of titanium.

* * * * *

UNITED STATES PATENT AND TRADEMARK OFFICE

CERTIFICATE OF CORRECTION

PATENT NO. : 4,965,045

DATED : OCTOBER 23, 1990

INVENTOR(S) : ANDREA GIARDA and SERGIO CERESERA

It is certified that error appears in the above-identified patent and that said Letters Patent is hereby corrected as shown below:

On the title page, item [73], please change the name of the assignee to read:

-- EUROPA METALLI - LMI S.p.A. --.

Signed and Sealed this

Seventeenth Day of November, 1992

*Attest:*

DOUGLAS B. COMER

*Attesting Officer*

*Acting Commissioner of Patents and Trademarks*